United States Patent [19]

Slater, Jr. et al.

[11] 4,390,936

[45] Jun. 28, 1983

[54] RESILIENT SUSPENSION MOUNT

[75] Inventors: Charles A. Slater, Jr., Overland Park, Kans.; Spencer A. Darby, Kansas City, Mo.

[73] Assignee: Peterson Manufacturing Co., Grandview, Mo.

[21] Appl. No.: 230,661

[22] Filed: Feb. 2, 1981

[51] Int. Cl.[3] ..... F21V 15/04

[52] U.S. Cl. ..... 362/390; 362/369; 362/306

[58] Field of Search ..... 362/390, 369, 306

[56] References Cited

U.S. PATENT DOCUMENTS

| | | | |
|---|---|---|---|
| 2,781,443 | 2/1957 | Cargle | 240/8.2 |
| 3,059,104 | 10/1962 | Dickson | 240/8.3 |
| 3,115,307 | 12/1963 | Dickson | 240/8.3 |
| 3,145,933 | 8/1964 | Dickson | 240/8.2 |
| 3,208,031 | 9/1965 | Dickson | 339/93 |
| 3,222,512 | 12/1965 | Dickson | 240/8.2 |
| 3,327,110 | 6/1967 | Baldwin | 240/90 |
| 3,534,321 | 10/1970 | Malachowski | 339/93 |
| 3,676,834 | 7/1972 | Kaldor et al. | 339/592 |
| 3,980,878 | 9/1976 | Crompton | 240/9.1 |
| 4,070,567 | 1/1978 | Crompton | 362/390 |
| 4,118,764 | 10/1978 | Bleiweiss et al. | 362/369 |
| 4,176,391 | 11/1979 | Kalik et al. | 362/390 |
| 4,231,081 | 10/1980 | Burruso | 362/390 |
| 4,282,566 | 10/1980 | Newman | 362/390 |

*Primary Examiner*—Stephen J. Lechert, Jr.
*Attorney, Agent, or Firm*—Litman, Day and McMahon

[57] ABSTRACT

A suspension mount is provided for suspending a light bulb in a lamp housing for use on vehicles, which mount inhibits the transmission of vibrations to the filaments in the light bulb. The mount is molded of a resilient material and comprises a light bulb receiving cup integrally formed with and suspended between two arms which support the mount on an associated housing. The arms are generally trapezoidal in plan view and have triangular recesses formed therein. Tubular members, having apertures therein, are formed in free ends of each arm. The tubular members fit over pegs extending outwardly from a surface of the lamp housing such that the mount is retained spaced apart from the housing surface.

18 Claims, 10 Drawing Figures

RESILIENT SUSPENSION MOUNT

BACKGROUND OF THE INVENTION

This invention relates to light bulb mounts for use with vehicles and, in particular, to vibration inhibiting light bulb mounts.

It is known that vibrations caused by the traversing of a vehicle over a roadway such as those produced by the vehicle tires and the engine are passed through the vehicle frame and the like to associated light bulbs. Filaments which are part of such light bulbs are very susceptible to fatigue failure when vibrated at frequencies which are at or near harmonic frequencies of the filaments. Reduction in failure of such filaments is particularly important in commercial vehicles which are preferably in constant use.

Therefore, attempts have been made to design a light bulb housing and mount which inhibits the transmittal of harmonic vibrations caused by road travel to the light bulb filament. There have been many such light bulb housings designed which attempt to reduce such transmitted vibrations. In generaly none of the prior art designs have been effectual in reducing the transmission of harmonic vibrations to an acceptable extent.

OBJECTS OF THE INVENTION

Therefore, it is the object of the present invention to provide a resilient suspension mount for suspending light bulbs in an associated housing and which inhibits the transmittal of road traveling induced harmonic vibrations to the light bulb filaments; to provide such a mount which is made of a resilient material and comprises a light bulb receiving cup suspended between opposing, triangular or trapezoidal shaped arms, which arms support the light bulb mount on an associated housing; to further provide such a mount which when used with an associated housing allows a light bulb to be placed therein in only a predetermined orientation; to further provide such a mount where the light bulb is snugly retained therein without the use of a metallic socket; and to provide such a mount which is simple in design, easy to manufacture, capable of an extended life, and particularly useful for the intended use thereof.

Other objects and advantages of this invention will become apparent from the following description taken in connection with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENT

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 2:
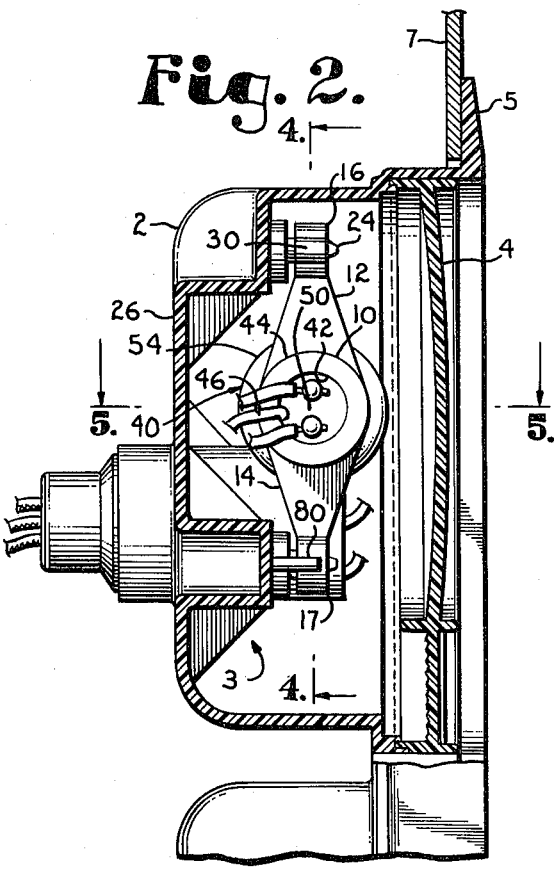
FIG. 2 is a fragmentary and enlarged cross-sectional view of the lamp housing taken along line 2—2 of FIG. 1 showing the resilient suspension mount as it is supported in the lamp housing.

The reference numeral 1 generally designates a resilient suspension mount comprising this invention. As shown in FIG. 2, the suspension mount is supported within a lamp assembly structure such as a conventional vehicle lamp housing 2, which housing has defined therein a cavity 3 and which is operably covered by a lens 4.

Figure 1:
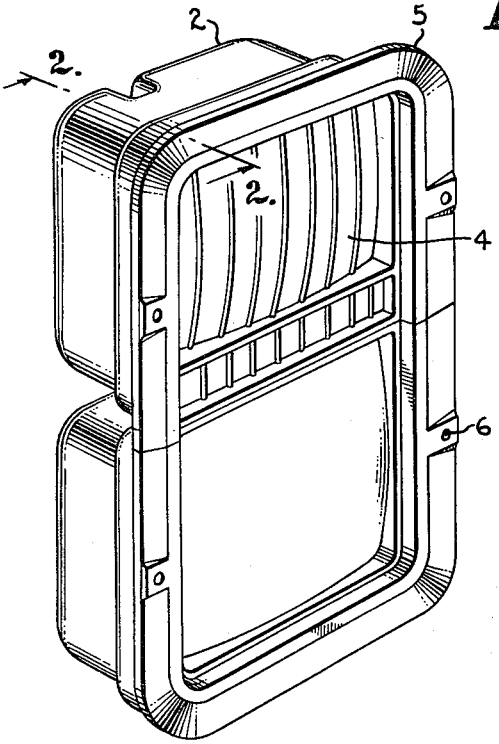
FIG. 1 is a perspective view of a lamp housing which includes therein a lamp and a resilient suspension mount embodying the present invention.

The housing 2 further has a lip 5 which includes apertures 6 therein to allow the housing 2 to be secured to an associated vehicle frame or structure 7. The lens 4 is retained in covering relation to the housing cavity 3 by means such as an adhesive agent or the like (not shown). The lens 4 may be colored so as to conform with any desired function. For example, the lens could be red to function as a stop light and turn indicator light or the lens could be white to function as a backing indicator light. As shown in FIG. 1, multiple combinations of the housings 2 may be utilized in adjacent grouping for multiple purpose requirements, such as using a stop-turn indicator light housing with a backing indicator light housing.

Figure 7:
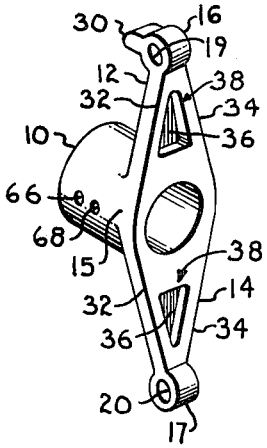
FIG. 7 is an enlarged perspective view of the resilient support mount.

The mount 1 is of preferably unitary molded construction of a resilient, rubber or plastic-like material, although it is foreseen that numerous materials of construction will perform satisfactorily under conditions in which the invention will be utilized. As best shown in FIG. 7, the mount 1 comprises a tubular bulb receiving cup portion 10, and opposed trapezoidally shaped arms 12 and 14 which extend outwardly from the cup 10 near a first end portion 15 thereof and are integral therewith. Preferably, the arms 12 and 14 are in a plane which bisects the cup 10 generally perpendicularly to the axis of the cup 10. Also preferably, the arms 12 and 14 are located at or near a first end portion of the cup 10. At free ends of arms 12 and 14 are tubular members 16 and 17 which contain therein passages 19 and 20 respectively. The tubular members 16 and 17 fit over and are snugly received and interferingly retained on attachment members such as elongate posts or the illustrated pegs 24 and 25 respectively, which pegs extend outwardly from a rear wall surface 26 of the lamp housing 2. Extending from the tubular member 16 in a direction parallel with a longitudinal axis of the cup 10 is a tab 30, the function of which will be explained later.

The arms 12 and 14 each have a pair of converging flanges 32 and 34 respectively, having a web 36 extending therebetween from opposed edges of the flanges 32 and 34. The web 36 is shown positioned on the side of the flanges 32 and 34 closest to the main body of the cup 10. A generally triangular recess 38 is thereby formed between the web 36 and the associated flanges 32 and 34.

An incandescent, filament-type light bulb 40 is operably received within the cup 10 so as to protrude from the first end portion 15 of the cup 10. An aperture 42 is positioned in an opposing cup end portion 44 which allows passage therethrough of associated wiring 46 for light bulb 40.

Figure 4:
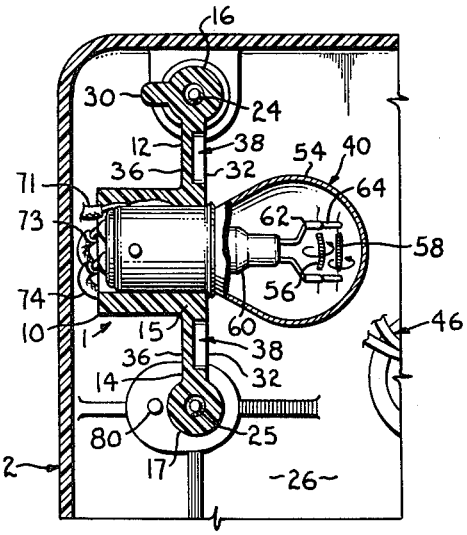
FIG. 4 is an enlarged and partial cross-sectional view of the lamp housing and suspension mount taken along lines 4—4 of FIG. 2.
Figure 5:
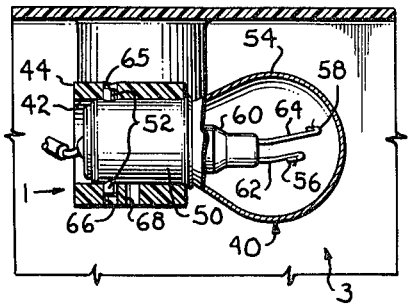
FIG. 5 is an enlarged and partial cross-sectional view of the lamp housing and suspension mount taken along line 5—5 of FIG. 2.
Figure 6:
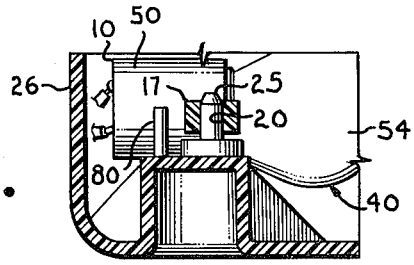
FIG. 6 is an enlarged and partial cross-sectional view of the lamp housing and suspension mount taken along line 6—6 of FIG. 3.

As best shown in FIG. 4, the light bulb 40 is of typical design and comprises a cylindrical metallic base portion 50 having oriented metal pins 52 extending radially outwardly therefrom at opposing circumferential positions. Depending on the manufactures of the bulb 40 the pins 52 can be formed at the same longitudinal position as shown in FIG. 5 or at different longitudinal positions. The bulb 40 further comprises a glass globe portion 54 in which are housed two filaments, a major filament 56 and a minor filament 58. An axis is formed through the arms 12 and 14 and pegs 24 and 25 about which the bulb 40 will tend to rotate if torque is applied to one of the opposite ends of the bulb 40. It is noted that the weights of the portions of the cup 10 on opposite sides of the arms 12 and 14 are preferably about equal such that no torque is applied to the first described axis when the housing 2 is in a generally static condition.

The cup 10 is designed so as to snugly receive and interferingly retain therein the bulb base 50 without using a metallic or the like auxilliary socket. Therefore, the suspension mount 1 can be one-piece molded while incorporating a resilient nature and, without further additions to the mount 1, the light bulb 40 can be operably positioned therein without any other manufacturing steps being undertaken, thereby saving labor.

As shown, the housing assembly 2 is utilized as the rear light unit for a commercial vehicle such as an over-the-road truck. The major filament 56 provides the lighting for stop and turn indicators, while the minor filament 58 provides continuous rear lighting for night driving. As shown in FIG. 5, filaments 56 and 58 are mounted on support members 62 and 64 respectively which extend outwardly from a globe base portion 60. The minor filament support member 64 is positioned rearwardly of and extends outwardly from the base portion 60 relative to the major filament support member 62. This orientation is necessary to provide the correct intensity of light emissions.

As shown in FIG. 5, pins 52 are received within apertures 65 and 66 which are formed in the cup 10, which pins 52 generally extend from the bulb base portion 50 at diametrically opposed positions, although some bulbs used with the present invention may not be so orientated and thus, the apertures corresponding to pins on the bulb would not be diametrically opposed. When the pins 52 are being positioned in the apertures 65 and 66 therefore, it is necessary for the person installing the bulb 40 to assure the proper filament orientation relative to the mount 1, that is the filaments 56 and 58 should be generally parallel to the arms 12 and 14 and the axis associated therewith. As stated before, some bulbs have pins 52 which are not diametrically opposed and in particular, are longitudinally spaced along the shaft of the bulb. When using such a bulb, the bulb may be positioned in the illustrated cup 10 such that only a single pin associated with the bulb is received in an aperture such as 68 in cup 10 or a specialized cup may be made having apertures to align with a particular bulb, thereby assuring that the proper orientation of the major and minor filaments 56 and 58 respectively is achieved.

The light bulb wiring 46 comprises a ground wire 71 which is connected to the metallic base 50 of the bulb and two lead wires 73 and 74 which run to major filament 56 and minor filament 58 respectively.

Figure 3:
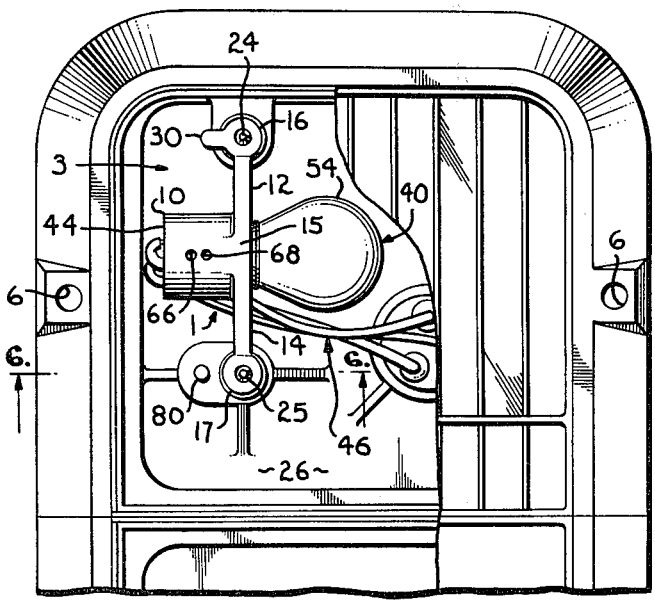
FIG. 3 is an enlarged and partial front elevational view of the lamp housing with portions of a housing lens broken away to show the suspension mount.

It is noted that the suspension mount 1 is generally symmetrical between the pegs 24 and 25, as shown in FIG. 7. As shown in FIGS. 3 and 4, the tab 30 which extends outwardly from arm 12 prohibits the placement of tubular member 16 over peg 25 since tab 30 would interferingly engage an auxilliary orientation peg 80 which extends outwardly from housing rear wall 26 adjacent peg 25, so that the mount 1 is urged into only one orientation on the housing 2. This further tends to assure that the proper orientations for the major filament 56 and the minor filament 58 are always attained.

Preferably, the suspension mount 1 is designed such that when a bulb 40 is placed therein, the assembled suspension mount 1 and bulb 40 are substantially supported about a common center of gravity. A plane passing through tubular members 16 and 17 including the axis thereof would generally pass through the center of gravity of the assembled suspension mount 1 and bulb 40. Further, a plane passing through tubular members 16 and 17 at a mid-point thereof and normal to an axis therethrough would also generally pass through the center of gravity of the assembled mount 1 and bulb 40. Also, the arms 12 and 14 are of equal length, such that the center of gravity of the assembled mount 1 and bulb 40 is generally equidistant between pegs 24 and 25. It is noted that the distance between pegs 24 and 25 is such that when the suspension mount is placed thereon, the suspension mount is tautly held between the two posts. Further, the wiring 46 is loosely received in the lamp housing 2 so as not to apply any stress to the suspension mount 1.

The suspension mount 1 is made of a suitable material that is resilient and pliable and which is also resistant to high temperatures since the temperature within the housing 2 can approach 300° Fahrenheit. The durometer of the material is preferably within a range of 40 to 75 and in particular, within the range of 55 to 60. It has been found that a material such as ethylene propylene, better known as EPDM, is a suitable material for the mount 1. The light bulb 40 may be a conventional light bulb commonly used in tail light assemblies which is commercially available and, which has major and minor filaments 56 and 58 respectively that are preferably fabricated of tungsten.

It is noted that conventional bulb filaments are susceptible to fatigue failure induced by vibration of the filaments due to vehicle vibration, such as engine imbalance and roadway irregularities encountered when an associated vehicle (not shown) travels over a roadway. When the frequency of the vibrations approaches the harmonic frequencies of the filaments fatigue failure is greatly enhanced. Therefore, it is very desirable to inhibit or dampen vibrations to the filaments particularly those that are at or near the harmonic frequencies of the filament.

Although the applicant does not want to be limited, the following is given as an explanation as to why the suspension mount effectively dampens the transmittal of roadway induced vibrations to the light bulb filaments 56 and 58. The arms 12 and 14, since they are made of a resilient material, tend to dampen vibrations to the light bulb 40 that would otherwise be transmitted thereto if the light bulb were rigidly mounted to the housing 3. Further, since the arms 12 and 14 are pliable the jolt of any violent movement such as caused by the traversing of bumps or railroad tracks is dampened thereby. Also, because of the design of the arms 12 and 14, notably the recess 38, the cup 10 is capable of flexure during violent movements while still retaining adequate strength to support the bulb 40 yet, because the arms 12 and 14 are trapezoidal, they tend to resist any rotation of the suspension mount about an axis through the arms 12 and 14.

It has been found that, if the thickness of the web 36, as shown in FIG. 4, is of the nature of 0.032 inches, the thickness of the arms 12 and 14 as viewed in FIG. 3 is approximately 0.140 inches and the width of flanges 32 and 34 as viewed from the left in FIG. 3, is approximately 0.100 inches that the suspension mount 1 will effectively dampen resonance in the filaments 56 and 54 when the frequency input to the suspension mount from an outside sources approaches the harmonic frequencies of the filaments, which for tungsten filaments, have been found to be between 300 and 450 hertz (Hz), and between 700 and 750 Hz.

Tests have been run on different configurations of the suspension mounts 1 to measure the ability of the mounts to inhibit or dampen vibrations of associated bulb filaments, particularly in the frequencies which are the harmonic frequencies of the filaments. Each test was conducted by placing a suspension mount on a stand which could be vibrated through a continuous range of frequencies.

Figure 10:
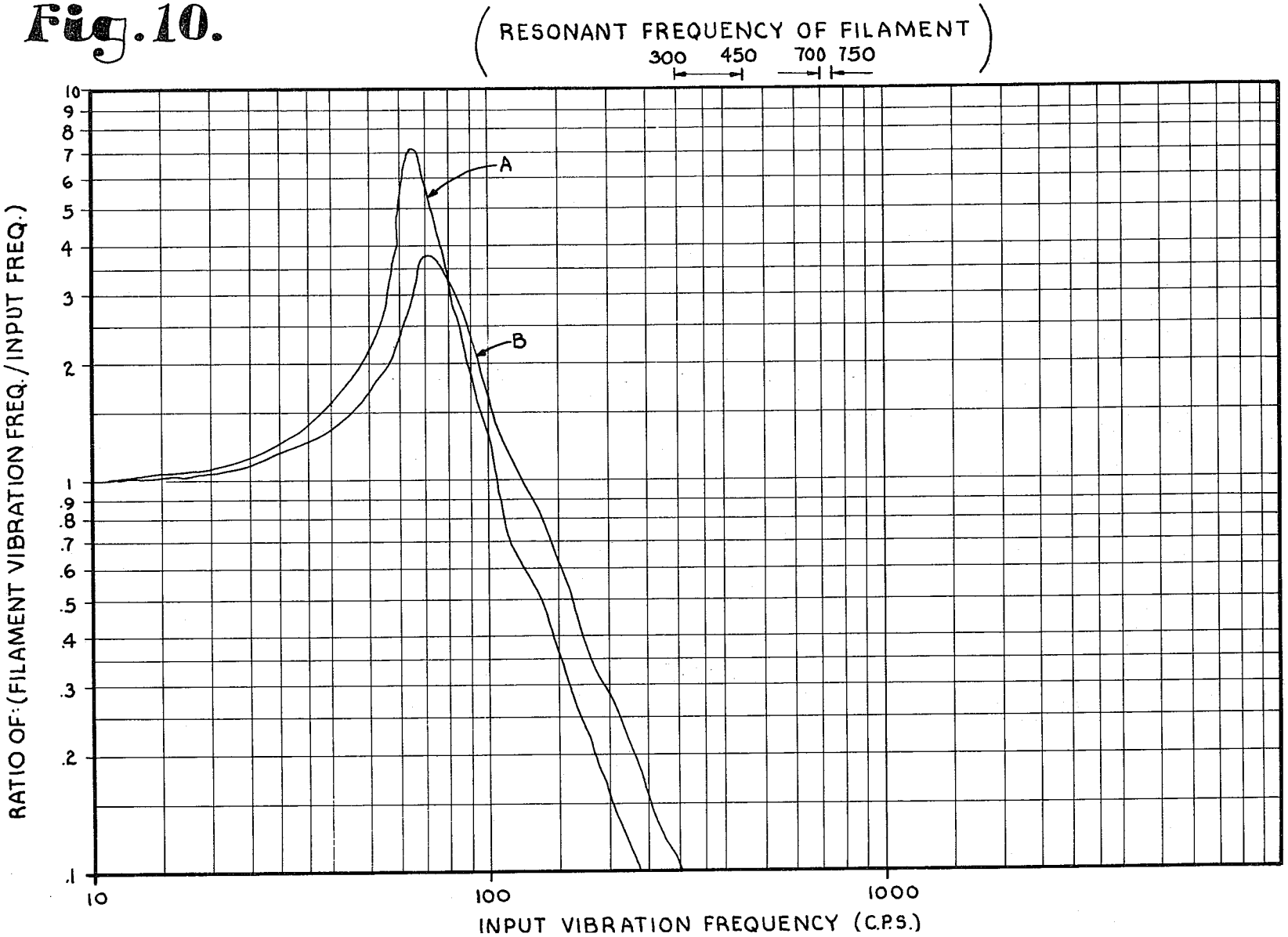
FIG. 10 is a graph showing the results of vibrational tests made on the suspension mount.

FIG. 10 is a graph having a logarithmic scale which shows the results of tests made on two suspension mounts according to the present invention. On the horizontal axis the oscillation frequency in Hz input into the suspension mount is shown to simulate the oscillation frequency that is a result of traveling over a roadway. The vertical axis is a ratio of the oscillation frequency of the light bulb, as measured as close to the position of the filaments as possible, in relation to the input oscillation frequency. It is noted that the ratio of output to input approaches zero as the input frequency approaches the resonant frequency of the filaments. Curve A is the result of a test done with a suspension mount wherein the distance between a centerline axis of each passage, such as passages 19 and 20 as shown in FIG. 1, is 2.350 inches. Curve B is a result of tests made on a suspension mount having 2.000 inches between the centerlines of the passages.

Figure 8:
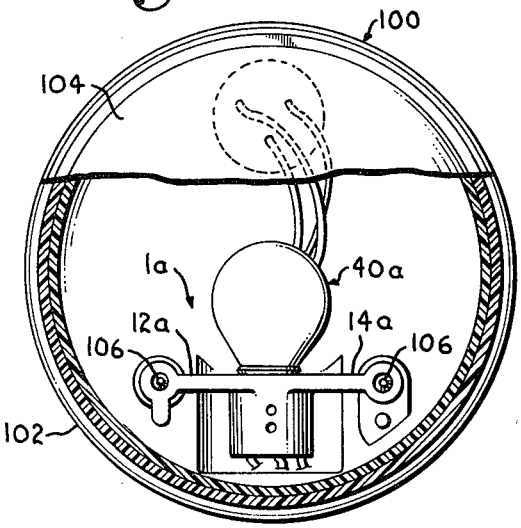
FIG. 8 is a front elevational view of the suspension mount shown in FIGS. 2–7, mounted in a modified lamp housing with portions of a lens of the modified housing broken away to show details thereof.
Figure 9:
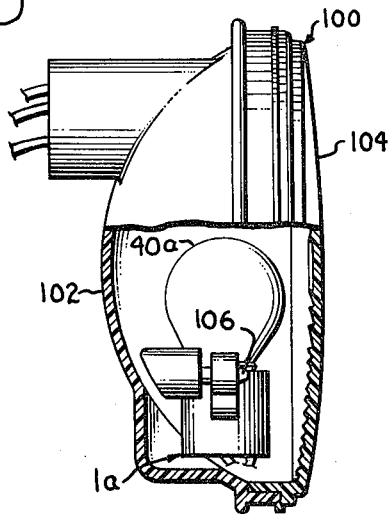
FIG. 9 is side elevational view of the modified lamp housing and suspension mount as shown in FIG. 8 with portions broken away to show details thereof.

In FIGS. 8 and 9 a resilient suspension mount 1*a* is shown which is essentially equivalent to mount 1 and has the same reference numerals followed by the suffix "a", being utilized with a different lamp assembly 100. The assembly 100 comprises a housing 102 and lens 104. As shown the suspension mount 1*a* is positioned on support pegs 106 such that the mount arms 12*a* and 14*a* are generally horizontal instead of vertical as shown in FIGS. 1 through 6.

It is foreseen that the suspension mount 1 is capable of being suspended in varying orientations. To do so, the strength of the arms 12 and 14 must be great enough to support the weight of the bulb 40 with only slight deformation of the arms 12 and 14 while still retaining enough resiliency and elasticity to dampen vibrations applied thereto.

It is to be understood that while certain embodiments of the present invention have been illustrated and described herein, it is not to be limited to the specific forms or arrangement of parts described and shown.

What is claimed and desired to secure by Letters Patent is:

1. A suspension mount for supporting a filament-type bulb on an associated lamp structure having first and second attachment members in such a manner so as to inhibit the transfer of vibrations to said bulb from said lamp structure; said mount comprising:

(a) a bulb receiving cup adapted to receive the bulb therein;

(b) first and second spaced resilient arms extending outwardly from the cup, said respective arms each including apertures at distal ends thereof each of said arm distal ends being engageable with an associated attachment member, said arms urged onto said respective associated attachment members by interferingly receiving said respective attachment member within said respective associated arm aperture, said arms being frictionally and removably retained thereon allowing selective removal of said suspension mount from said lamp structure.

2. A mount as set forth in claim 1 wherein:

(a) said first and second arms are integral with and extend in opposed directions from said cup.

3. A mount as set forth in claim 2 wherein:

(a) a common axis is associated with said first and second arms;

(b) said cup is aligned such that the bulb is received therein generally perpendicular to said axis of said arms; and (c) said cup is positioned relative to said arms such that the center of gravity of said cup with the bulb therein is generally on said axis of said arms.

4. A suspension mount for supporting a filament-type light bulb on an associated lamp structure having first and second attachment members in such a manner so as to inhibit the transfer of vibrations to said bulb from said lamp structure; said mount comprising:

(a) a resilient bulb receiving cup adapted to receive said bulb therein;

(b) first and second spaced resilient straight arms extending outwardly from said cup in a straight line, said arms each including a distal end engageable with a respective associated attachment member, said arms each extending outwardly from said cup in a straight line so as to be aligned and substantially within a pane containing said respective arm distal ends at a point of engagement with said respective associated attachment member.

5. A suspension mount for supporting a filament-type light bulb on an associated lamp structure having first and second attachment members in such a manner so as to inhibit the transfer of vibration to said bulb from said lamp structure; said mount comprising:

(a) resilient bulb receiving cup adapted to receive said bulb therein;

(b) first and second spaced resilient arms extending outwardly from said cup, each of said arms including a distal end engageable with an associated attachment member for supporting said mount within said lamp structure; said arms each being generally trapezoidal in shape tapering in size adjacent said arm distal ends.

6. A mount as set forth in claim 5 wherein said arms each comprise:

(a) two flanges having tubular members attached near ends thereof opposite said cup, said tubular members each containing an aperture for snugly receiving a respective attaching member therein; and (b) a web is positioned between said flanges so as to define a recess between said flanges and said cup.

7. A mount as set forth in claim 6 wherein:

(a) said apertures in said tubular members are positioned such that a line drawn therebetween generally passes through a center of gravity of said mount when the bulb is positioned therein.

8. A mount as set forth in claim 7 wherein:

(a) said apertures in said tubular members are each equidistant from said center of gravity.

9. A mount as set forth in claim 1 wherein:

(a) said cup and said arms are integrally molded.

10. A mount as set forth in claim 9 wherein:

(a) said mount is constructed of an elastic material having a durometer within a range of approximately 50 to 65.

11. A mount as set forth in claim 9 wherein:

(a) said mount is constructed of ethylene-propylene.

12. A suspension mount for supporting a filament-type light bulb on an associated lamp structure having first and second attachment members in such a manner so as to inhibit the transfer of vibrations to said bulb from said lamp structure, the attachment members extending outwardly from a wall of the structure and comprising elongate pegs; said mount comprising:

(a) a resilient bulb receiving cup having an axis thereof and a first end in which the bulb is received;

(b) first and second resilient arms integrally formed with said cup and extending outwardly from said cup first end substantially within a plane pependicular to said cup axis, said arms being trapezoidal in shape tapering toward distal ends each thereof, each arm comprising two converging flanges having a web positioned therebetween defining a recess between said flanges and said cup; said respective arm distal ends each including a tubular member having an axis substantially parallel with said cup axis, said tubular members each interferingly and removably received over a respective attachment member whereby said suspension mount can be selectively removed from said lamp structure.

13. A lamp assembly for use in vehicles subject to vibration comprising:

(a) a support structure adapted to be secured to the vehicle;

(b) first and second spaced and generally parallel posts projecting from said support structure;

(c) a filament-type light bulb;

(d) wiring for connecting said bulb to a source of power in the vehicle; and (e) a mount for retaining said bulb in spaced relationship from said support structure; said mount comprising:

(2) a bulb receiving resilient cup; and (2) first and second spaced and resilient arms; said arms extending outwardly from said cup and being integral therewith; each of said arms including attachment means near ends thereof opposite said cup such that said first and second arms are frictionally and removably retained on said first and second posts whereby said mount can be selectively removed from said support structure respectively.

14. An assembly as set forth in claim 13 wherein:

(a) each of said arms include a respective tubular member at ends thereof opposite said cup; each tubular member having an aperture therethrough into which a respective post is snugly received; and (b) said apertures are aligned such that a line passing through both of said apertures also generally passes though the center of gravity of the mount when said bulb is positioned therein.

15. An assembly as set forth in claim 13 wherein:

(a) said cup and said arms are constructed of an elastic material having a durometer in the range of approximately 50 to 65.

16. An assembly as set forth in claim 13 wherein:

(a) said wires are connected directly to said bulb and are slackly connected to the vehicle such that said wires do not substantially transmit vibration to or interfere with movement of said bulb.

17. An assembly as set forth in claim 16 wherein:

(a) said cup is an elastic material; and (b) said mount does not include a metallic bulb socket, such that said bulb is directly received in said cup.

18. An assembly as set forth in claim 13 wherein:

(a) each of said arms diverges away from said cup; and includes;

(b) a pair of outside flanges, each flange extending from said cup at one end thereof and joining with the other flange at the opposite end thereof; and (c) a web between said flanges and joined therewith;

(d) whereby each arm resiliently resists torquing forces about an axis thereof while remaining relatively light in weight.

* * * * *